US011180943B2

(12) United States Patent
Khan et al.

(10) Patent No.: US 11,180,943 B2
(45) **Date of Patent: *Nov. 23, 2021**

(54) ANTI-PINCH LOGIC FOR DOOR OPENING ACTUATOR

(71) Applicant: Ford Global Technologies, LLC, Dearborn, MI (US)

(72) Inventors: Muhammad Omer Khan, Markham (CA); Kosta Papanikolaou, Huntington Woods, MI (US); Livianu Dorin Puscas, Rochester Hills, MI (US); Christopher Matthew Radjewski, Macomb, MI (US); H. Paul Tsvi Linden, Southfield, MI (US); George Anthony Bernwanger, Jr., Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 178 days.

This patent is subject to a terminal disclaimer.

(21) Appl. No.: 16/573,067

(22) Filed: Sep. 17, 2019

(65) Prior Publication Data

US 2020/0011111 A1 Jan. 9, 2020

Related U.S. Application Data

(63) Continuation of application No. 15/269,281, filed on Sep. 19, 2016, now Pat. No. 10,458,171.

(51) Int. Cl.

| | |
|---|---|
| ***E05F 11/00*** | (2006.01) |
| ***E05F 15/42*** | (2015.01) |
| ***E05F 15/611*** | (2015.01) |

(52) U.S. Cl.
CPC ..... *E05F 15/42* (2015.01); *E05F 15/611* (2015.01); *E05Y 2201/41* (2013.01);
(Continued)

(58) Field of Classification Search
CPC ..... E05F 15/42; E05F 15/611; E05Y 2400/32
(Continued)

(56) References Cited

U.S. PATENT DOCUMENTS

| | | | |
|---|---|---|---|
| 2,229,909 | A | 1/1941 | Wread |
| 2,553,023 | A | 5/1951 | Walters |

(Continued)

FOREIGN PATENT DOCUMENTS

| | | | |
|---|---|---|---|
| CN | 2683455 | Y | 3/2005 |
| CN | 1232936 | C | 12/2005 |

(Continued)

OTHER PUBLICATIONS

Zipcar.com, "Car Sharing from Zipcar: How Does car Sharing Work?" Feb. 9, 2016, 6 pages.

(Continued)

*Primary Examiner* — Jerry E Redman
(74) *Attorney, Agent, or Firm* — David L. Coppiellie; Price Heneveld LLP

(57) ABSTRACT

A vehicle door system includes a vehicle door and electrically-powered linear and rotary actuators. The vehicle door system also includes a pinch sensor. Upon receiving an open door command, a controller actuates the linear actuator and then actuates the rotary actuator to open the door. The controller also actuates the linear actuator to prevent closing of the door if the pinch-sensor detects an object in a door opening. The controller actuates the rotary actuator to close the door upon receiving a close door command.

17 Claims, 8 Drawing Sheets

(52) U.S. Cl.
CPC ... *E05Y 2201/422* (2013.01); *E05Y 2201/434* (2013.01); *E05Y 2400/32* (2013.01); *E05Y 2400/40* (2013.01); *E05Y 2400/44* (2013.01); *E05Y 2400/45* (2013.01); *E05Y 2400/54* (2013.01); *E05Y 2800/41* (2013.01); *E05Y 2900/531* (2013.01)

(58) Field of Classification Search
USPC ..... 49/349, 360, 333, 334, 335, 336, 337
See application file for complete search history.

(56) References Cited

U.S. PATENT DOCUMENTS 3,479,767 A 11/1969 Gardner et al.
3,605,459 A * 9/1971 Van Dalen ..... E05B 47/0038 70/144
3,751,718 A 8/1973 Hanchett
3,771,823 A 11/1973 Schnarr
3,854,310 A 12/1974 Paull
3,858,922 A 1/1975 Yamanaka
4,193,619 A 3/1980 Jeril
4,206,491 A 6/1980 Ligman et al.
4,425,597 A 1/1984 Schramm
4,457,148 A 7/1984 Johansson et al.
4,640,050 A 2/1987 Yamagishi et al.
4,672,348 A 6/1987 Duve
4,674,230 A * 6/1987 Takeo ..... E05C 17/003 49/28
4,674,781 A 6/1987 Reece et al.
4,702,117 A 10/1987 Tsutsumi et al.
4,848,031 A 6/1989 Yamagishi et al.
4,858,971 A 8/1989 Haag
4,889,373 A 12/1989 Ward et al.
4,929,007 A 5/1990 Bartczak et al.
5,018,057 A 5/1991 Biggs et al.
5,056,343 A 10/1991 Kleefeldt et al.
5,058,258 A 10/1991 Harvey
5,074,073 A 12/1991 Zwebner
5,092,637 A 3/1992 Miller
5,173,991 A 12/1992 Carswell
5,239,779 A 8/1993 DeLand et al.
5,263,762 A 11/1993 Long et al.
5,297,010 A 3/1994 Camarota et al.
5,332,273 A 7/1994 Komachi
5,334,969 A 8/1994 Abe et al.
5,494,322 A 2/1996 Menke
5,497,641 A 3/1996 Linde et al.
5,535,608 A 7/1996 Brin
5,547,208 A 8/1996 Chappell et al.
5,551,187 A 9/1996 Brouwer et al.
5,581,230 A 12/1996 Barrett
5,583,405 A 12/1996 Sai et al.
5,613,716 A 3/1997 Cafferty
5,618,068 A 4/1997 Mitsui et al.
5,632,120 A 5/1997 Shigematsu et al.
5,632,515 A 5/1997 Dowling
5,644,869 A 7/1997 Buchanan, Jr.
5,653,484 A 8/1997 Brackmann et al.
5,662,369 A 9/1997 Tsuge
5,684,470 A 11/1997 DeLand et al.
5,744,874 A 4/1998 Yoshida et al.
5,755,059 A 5/1998 Schap
5,783,994 A 7/1998 Koopman, Jr. et al.
5,802,894 A 9/1998 Jahrsetz et al.
5,808,555 A 9/1998 Bartel
5,852,944 A 12/1998 Collard, Jr. et al.
5,859,479 A 1/1999 David
5,895,089 A 4/1999 Singh et al.
5,896,026 A 4/1999 Higgins
5,896,768 A 4/1999 Cranick et al.
5,898,536 A 4/1999 Won
5,901,991 A 5/1999 Hugel et al.
5,921,612 A 7/1999 Mizuki et al.
5,927,794 A 7/1999 Mobius
5,964,487 A 10/1999 Shamblin
5,979,754 A 11/1999 Martin et al.
5,992,194 A 11/1999 Baukholt et al.
6,000,257 A 12/1999 Thomas
6,027,148 A 2/2000 Shoemaker
6,038,895 A 3/2000 Menke et al.
6,042,159 A 3/2000 Spitzley et al.
6,043,735 A 3/2000 Barrett
6,050,117 A 4/2000 Weyerstall
6,056,076 A 5/2000 Bartel et al.
6,065,316 A 5/2000 Sato et al.
6,072,403 A 6/2000 Iwasaki et al.
6,075,294 A 6/2000 Boom et al.
6,075,298 A 6/2000 Maue et al.
6,089,626 A 7/2000 Shoemaker
6,091,162 A 7/2000 Williams, Jr. et al.
6,099,048 A 8/2000 Salmon et al.
6,125,583 A 10/2000 Murray et al.
6,130,614 A 10/2000 Miller
6,145,918 A 11/2000 Wilbanks, II
6,157,090 A 12/2000 Vogel
6,181,024 B1 1/2001 Geil
6,198,995 B1 3/2001 Settles et al.
6,241,294 B1 6/2001 Young et al.
6,247,343 B1 6/2001 Weiss et al.
6,256,932 B1 7/2001 Jyawook et al.
6,271,745 B1 8/2001 Anazi et al.
6,305,737 B1 10/2001 Corder et al.
6,341,448 B1 1/2002 Murray et al.
6,357,803 B1 3/2002 Lorek
6,361,091 B1 3/2002 Weschler
6,405,485 B1 6/2002 Itami et al.
6,406,073 B1 6/2002 Watanabe
6,441,512 B1 8/2002 Jakel et al.
6,460,905 B2 10/2002 Suss
6,470,719 B1 10/2002 Franz et al.
6,480,098 B2 11/2002 Flick
6,481,056 B1 11/2002 Jesse
6,515,377 B1 2/2003 Uberlein et al.
6,523,376 B2 2/2003 Baukholt et al.
6,550,826 B2 4/2003 Fukushima et al.
6,554,328 B2 4/2003 Cetnar et al.
6,556,900 B1 4/2003 Brynielsson
6,602,077 B2 8/2003 Kasper et al.
6,606,492 B1 8/2003 Losey
6,629,711 B1 10/2003 Gleason et al.
6,639,161 B2 10/2003 Meagher et al.
6,657,537 B1 12/2003 Hauler
6,659,515 B2 12/2003 Raymond et al.
6,701,671 B1 3/2004 Fukumoto et al.
6,712,409 B2 3/2004 Monig
6,715,806 B2 4/2004 Arlt et al.
6,734,578 B2 5/2004 Konno et al.
6,740,834 B2 5/2004 Sueyoshi et al.
6,768,413 B1 7/2004 Kemmann et al.
6,779,372 B2 8/2004 Arlt et al.
6,783,167 B2 8/2004 Bingle et al.
6,786,070 B1 9/2004 Dimig et al.
6,794,837 B1 9/2004 Whinnery et al.
6,825,752 B2 11/2004 Nahata et al.
6,829,357 B1 12/2004 Alrabady et al.
6,843,085 B2 1/2005 Dimig
6,854,870 B2 2/2005 Huizenga
6,879,058 B2 4/2005 Lorenz et al.
6,883,836 B2 4/2005 Breay et al.
6,883,839 B2 4/2005 Belmond et al.
6,910,302 B2 6/2005 Crawford
6,914,346 B2 7/2005 Girard
6,923,479 B2 8/2005 Aiyama et al.
6,933,655 B2 8/2005 Morrison et al.
6,946,978 B2 9/2005 Schofield
7,005,959 B2 2/2006 Amagasa
7,038,414 B2 5/2006 Daniels et al.
7,055,997 B2 6/2006 Baek
7,062,945 B2 6/2006 Saitoh et al.
7,070,018 B2 7/2006 Kachouh
7,070,213 B2 7/2006 Willats et al.
7,090,285 B2 8/2006 Markevich et al.
7,091,823 B2 8/2006 Ieda et al.
7,091,836 B2 8/2006 Kachouh et al.

(56) References Cited

U.S. PATENT DOCUMENTS 7,097,226 B2 8/2006 Bingle et al.
7,106,171 B1 9/2006 Burgess
7,108,301 B2 9/2006 Louvel
7,126,453 B2 10/2006 Sandau et al.
7,145,436 B2 12/2006 Ichikawa et al.
7,161,152 B2 1/2007 Dipoala
7,170,253 B2 1/2007 Spurr et al.
7,173,346 B2 2/2007 Aiyama et al.
7,176,810 B2 2/2007 Inoue
7,180,400 B2 2/2007 Amagasa
7,192,076 B2 3/2007 Ottino
7,204,530 B2 4/2007 Lee
7,205,777 B2 4/2007 Schultz et al.
7,221,255 B2 5/2007 Johnson et al.
7,224,259 B2 5/2007 Bemond et al.
7,248,955 B2 7/2007 Hein et al.
7,263,416 B2 8/2007 Sakurai et al.
7,270,029 B1 9/2007 Papanikolaou et al.
7,325,843 B2 2/2008 Coleman et al.
7,342,373 B2 * 3/2008 Newman ..... E05F 15/40 318/466
7,360,803 B2 4/2008 Parent et al.
7,363,788 B2 4/2008 Dimig et al.
7,375,299 B1 5/2008 Pudney
7,399,010 B2 7/2008 Hunt et al.
7,446,645 B2 11/2008 Steegmann
7,576,631 B1 8/2009 Bingle et al.
7,642,669 B2 1/2010 Spurr
7,686,378 B2 3/2010 Gisler et al.
7,688,179 B2 3/2010 Kurpinski et al.
7,705,722 B2 4/2010 Shoemaker et al.
7,747,286 B2 6/2010 Conforti
7,780,207 B2 8/2010 Gotou et al.
7,791,218 B2 9/2010 Mekky et al.
7,926,385 B2 4/2011 Papanikolaou et al.
7,931,314 B2 4/2011 Nitawaki et al.
7,937,893 B2 5/2011 Pribisic
8,028,375 B2 10/2011 Nakaura et al.
8,093,987 B2 1/2012 Kurpinski et al.
8,126,450 B2 2/2012 Howarter et al.
8,141,296 B2 3/2012 Bem
8,141,916 B2 3/2012 Tomaszewski et al.
8,169,317 B2 5/2012 Lemerand et al.
8,193,462 B2 6/2012 Zanini et al.
8,224,313 B2 7/2012 Howarter et al.
8,272,165 B2 9/2012 Tomioke
8,376,416 B2 2/2013 Arabia, Jr. et al.
8,398,128 B2 3/2013 Arabia et al.
8,405,515 B2 3/2013 Ishihara et al.
8,405,527 B2 3/2013 Chung et al.
8,419,114 B2 4/2013 Fannon
8,451,087 B2 5/2013 Krishnan et al.
8,454,062 B2 6/2013 Rohlfing et al.
8,474,889 B2 7/2013 Reifenberg et al.
8,511,739 B2 * 8/2013 Brown ..... E05F 15/605 296/146.12
8,532,873 B1 9/2013 Bambenek
8,534,101 B2 9/2013 Mette et al.
8,544,901 B2 10/2013 Krishnan et al.
8,573,657 B2 11/2013 Papanikolaou et al.
8,584,402 B2 * 11/2013 Yamaguchi ..... E05F 1/14 49/379
8,601,903 B1 12/2013 Klein et al.
8,616,595 B2 12/2013 Wellborn, Sr. et al.
8,648,689 B2 2/2014 Hathaway et al.
8,690,204 B2 4/2014 Lang et al.
8,739,468 B2 * 6/2014 Yamaguchi ..... E05F 3/106 49/379
8,746,755 B2 6/2014 Papanikolaou et al.
8,826,596 B2 9/2014 Tensing
8,833,811 B2 9/2014 Ishikawa
8,903,605 B2 12/2014 Bambenek
8,915,524 B2 * 12/2014 Charnesky ..... E05B 79/20 292/216
8,963,701 B2 2/2015 Rodriguez
8,965,287 B2 2/2015 Lam
9,003,707 B2 * 4/2015 Reddmann ..... E05F 15/60 49/278
9,076,274 B2 7/2015 Kamiya
9,159,219 B2 10/2015 Magnar et al.
9,184,777 B2 11/2015 Esselink et al.
9,187,012 B2 11/2015 Sachs et al.
9,189,900 B1 11/2015 Penilla et al.
9,260,882 B2 2/2016 Krishnan et al.
9,284,757 B2 3/2016 Kempel
9,322,204 B2 4/2016 Suzuki
9,353,566 B2 5/2016 Miu et al.
9,382,741 B2 7/2016 Konchan et al.
9,405,120 B2 8/2016 Graf
9,409,579 B2 8/2016 Eichin et al.
9,416,565 B2 8/2016 Papanikolaou et al.
9,475,369 B2 10/2016 Sugiura
9,481,325 B1 11/2016 Lange
9,493,975 B1 11/2016 Li
9,518,408 B1 12/2016 Krishnan
9,522,590 B2 12/2016 Fujimoto et al.
9,546,502 B2 1/2017 Lange
9,551,166 B2 1/2017 Patel et al.
9,725,069 B2 8/2017 Krishnan
9,777,528 B2 * 10/2017 Elie ..... E05F 15/77
9,797,178 B2 * 10/2017 Elie ..... G01V 3/08
9,797,181 B2 10/2017 Wheeler et al.
9,834,964 B2 12/2017 Van Wiemeersch et al.
9,845,071 B1 12/2017 Krishnan
9,903,142 B2 2/2018 Van Wiemeersch et al.
9,909,344 B2 3/2018 Krishnan et al.
9,957,737 B2 5/2018 Patel et al.
9,995,066 B1 * 6/2018 Ottolini ..... E05F 15/619
10,008,069 B2 * 6/2018 Elie ..... E05F 15/73
10,822,848 B2 * 11/2020 Worden ..... E05C 17/203
10,907,386 B2 * 2/2021 Walawender ..... E05F 15/76
2001/0005078 A1 6/2001 Fukushima et al.
2001/0030871 A1 10/2001 Anderson
2002/0000726 A1 1/2002 Zintler
2002/0111844 A1 8/2002 Vanstory et al.
2002/0121967 A1 9/2002 Bowen et al.
2002/0186144 A1 12/2002 Meunier
2003/0009855 A1 1/2003 Budzynski
2003/0025337 A1 2/2003 Suzuki et al.
2003/0038544 A1 * 2/2003 Spurr ..... E05B 81/56 307/10.1
2003/0101781 A1 6/2003 Budzynski et al.
2003/0107473 A1 6/2003 Pang et al.
2003/0111863 A1 6/2003 Weyerstall et al.
2003/0139155 A1 7/2003 Sakai
2003/0172695 A1 9/2003 Buschmann
2003/0182863 A1 10/2003 Mejean et al.
2003/0184098 A1 10/2003 Aiyama
2003/0216817 A1 11/2003 Pudney
2004/0061462 A1 * 4/2004 Bent ..... E05F 15/41 318/280
2004/0093155 A1 5/2004 Simonds et al.
2004/0124708 A1 7/2004 Giehler et al.
2004/0195845 A1 10/2004 Chevalier
2004/0217601 A1 11/2004 Garnault et al.
2005/0057047 A1 3/2005 Kachouch
2005/0068712 A1 3/2005 Schulz et al.
2005/0216133 A1 9/2005 MacDougall et al.
2005/0218913 A1 10/2005 Inaba
2006/0056663 A1 3/2006 Call
2006/0100002 A1 5/2006 Luebke et al.
2006/0186987 A1 8/2006 Wilkins
2007/0001467 A1 1/2007 Muller et al.
2007/0090654 A1 * 4/2007 Eaton ..... E05B 81/16 292/201
2007/0115191 A1 5/2007 Hashiguchi et al.
2007/0120645 A1 5/2007 Nakashima
2007/0126243 A1 6/2007 Papanikolaou et al.
2007/0132553 A1 6/2007 Nakashima
2007/0170727 A1 7/2007 Kohlstrand et al.
2008/0021619 A1 1/2008 Steegmann et al.
2008/0060393 A1 3/2008 Johansson et al.
2008/0068129 A1 3/2008 Ieda et al.

(56) References Cited

U.S. PATENT DOCUMENTS

2008/0129446 A1 6/2008 Vader
2008/0143139 A1 6/2008 Bauer et al.
2008/0202912 A1 8/2008 Boddie et al.
2008/0203737 A1 8/2008 Tomaszewski et al.
2008/0211623 A1 9/2008 Scheurich
2008/0217956 A1 9/2008 Gschweng et al.
2008/0224482 A1 9/2008 Cumbo et al.
2008/0230006 A1 9/2008 Kirchoff et al.
2008/0250718 A1 10/2008 Papanikolaou et al.
2008/0296927 A1* 12/2008 Gisler ..... E05F 15/43 296/146.4
2008/0303291 A1 12/2008 Spurr
2008/0307711 A1 12/2008 Kern et al.
2009/0033104 A1 2/2009 Konchan et al.
2009/0033477 A1 2/2009 Ilium et al.
2009/0145181 A1 6/2009 Pecoul et al.
2009/0160211 A1 6/2009 Krishnan et al.
2009/0177336 A1 7/2009 McClellan et al.
2009/0240400 A1 9/2009 Lachapelle et al.
2009/0257241 A1 10/2009 Meinke et al.
2010/0007463 A1 1/2010 Dingman et al.
2010/0052337 A1 3/2010 Arabia et al.
2010/0060505 A1 3/2010 Witkowski
2010/0097186 A1 4/2010 Wielebski
2010/0175945 A1 7/2010 Helms
2010/0235057 A1 9/2010 Papanikolaou et al.
2010/0235058 A1 9/2010 Papanikolaou et al.
2010/0235059 A1 9/2010 Krishnan et al.
2010/0237635 A1 9/2010 Ieda et al.
2010/0253535 A1 10/2010 Thomas
2010/0265034 A1 10/2010 Cap et al.
2010/0315267 A1 12/2010 Chung et al.
2011/0041409 A1 2/2011 Newman et al.
2011/0060480 A1 3/2011 Mottla et al.
2011/0148575 A1 6/2011 Sobecki et al.
2011/0154740 A1 6/2011 Matsumoto et al.
2011/0180350 A1 7/2011 Thacker
2011/0203181 A1* 8/2011 Magner ..... E05B 83/01 49/324
2011/0203336 A1 8/2011 Mette et al.
2011/0227351 A1 9/2011 Grosedemouge
2011/0248862 A1 10/2011 Budampati
2011/0252845 A1 10/2011 Webb et al.
2011/0254292 A1 10/2011 Ishii
2011/0295469 A1* 12/2011 Rafii ..... G06T 7/254 701/49
2011/0313937 A1 12/2011 Moore, Jr. et al.
2012/0119524 A1 5/2012 Bingle et al.
2012/0154292 A1 6/2012 Zhao et al.
2012/0180394 A1* 7/2012 Shinohara ..... E05F 15/00 49/349
2012/0205925 A1 8/2012 Muller et al.
2012/0228886 A1 9/2012 Muller et al.
2012/0252402 A1 10/2012 Jung
2013/0049403 A1 2/2013 Fannon et al.
2013/0069761 A1 3/2013 Tieman
2013/0079984 A1 3/2013 Aerts et al.
2013/0104459 A1 5/2013 Patel et al.
2013/0127180 A1 5/2013 Heberer et al.
2013/0138303 A1* 5/2013 McKee ..... E05F 15/73 701/49
2013/0207794 A1 8/2013 Patel
2013/0282226 A1 10/2013 Pollmann
2013/0295913 A1 11/2013 Matthews, III et al.
2013/0311046 A1 11/2013 Heberer et al.
2013/0321065 A1 12/2013 Salter et al.
2013/0325521 A1 12/2013 Jameel
2014/0000165 A1* 1/2014 Patel ..... E05B 81/76 49/31
2014/0007404 A1 1/2014 Krishnan et al.
2014/0015637 A1 1/2014 Dassanakake et al.
2014/0088825 A1 3/2014 Lange et al.
2014/0129113 A1 5/2014 Van Wiemeersch et al.
2014/0150581 A1* 6/2014 Scheuring ..... E05F 15/622 74/89.38
2014/0156111 A1 6/2014 Ehrman
2014/0188999 A1 7/2014 Leonard et al.
2014/0200774 A1 7/2014 Lange et al.
2014/0227980 A1 8/2014 Esselink et al.
2014/0242971 A1 8/2014 Aladenize et al.
2014/0245666 A1* 9/2014 Ishida ..... E05F 15/655 49/349
2014/0256304 A1 9/2014 Frye et al.
2014/0278599 A1 9/2014 Reh
2014/0293753 A1 10/2014 Pearson
2014/0338409 A1 11/2014 Kraus et al.
2014/0347163 A1 11/2014 Banter et al.
2015/0001926 A1 1/2015 Kageyama et al.
2015/0048927 A1 2/2015 Simmons
2015/0059250 A1 3/2015 Miu et al.
2015/0084739 A1 3/2015 Lemoult et al.
2015/0149042 A1 5/2015 Cooper et al.
2015/0161832 A1 6/2015 Esselink et al.
2015/0197205 A1 7/2015 Xiong
2015/0240548 A1* 8/2015 Bendel ..... E05F 15/70 701/49
2015/0294518 A1 10/2015 Peplin
2015/0330112 A1 11/2015 Van Wiemeersch et al.
2015/0330113 A1 11/2015 Van Wiemeersch et al.
2015/0330114 A1* 11/2015 Linden ..... E05B 81/14 292/194
2015/0330117 A1 11/2015 Van Wiemeersch et al.
2015/0330133 A1* 11/2015 Konchan ..... E05B 81/76 296/146.4
2015/0360545 A1* 12/2015 Nania ..... B60J 7/0573 296/223
2015/0371031 A1 12/2015 Ueno et al.
2016/0032624 A1* 2/2016 Bendel ..... E05B 81/64 49/31
2016/0060909 A1* 3/2016 Krishnan ..... E05B 81/86 292/194
2016/0130843 A1 5/2016 Bingle
2016/0138306 A1 5/2016 Krishnan et al.
2016/0153216 A1 6/2016 Funahashi et al.
2016/0273255 A1 9/2016 Sukuki et al.
2016/0326779 A1 11/2016 Papanikolaou et al.
2017/0014039 A1 1/2017 Pahlevan et al.
2017/0022742 A1 1/2017 Seki et al.
2017/0030737 A1* 2/2017 Elie ..... G01D 5/34
2017/0058588 A1 3/2017 Wheeler et al.
2017/0074006 A1 3/2017 Patel et al.
2017/0247016 A1 8/2017 Krishnan
2017/0247927 A1* 8/2017 Elie ..... E05F 15/611
2017/0270490 A1 9/2017 Penilla et al.
2017/0306662 A1 10/2017 Och et al.
2017/0349146 A1 12/2017 Krishnan
2018/0038147 A1* 2/2018 Linden ..... E05B 81/56
2018/0051493 A1 2/2018 Krishnan et al.
2018/0051498 A1 2/2018 Van Wiemeersch et al.
2018/0058128 A1* 3/2018 Khan ..... E05F 15/60
2018/0065598 A1 3/2018 Krishnan
2018/0080270 A1* 3/2018 Khan ..... E05F 15/611
2018/0106081 A1* 4/2018 Bendel ..... E05B 81/13
2018/0128022 A1 5/2018 Van Wiemeersch et al.
2019/0203508 A1* 7/2019 Harajli ..... E05B 81/20

FOREIGN PATENT DOCUMENTS

CN 201198681 Y 2/2009
CN 201280857 7/2009
CN 101527061 A 9/2009
CN 201567872 U 9/2010
CN 101932466 A 12/2010
CN 201915717 U 8/2011
CN 202200933 U 4/2012
CN 202686247 U 1/2013
CN 103206117 A 7/2013
CN 103264667 A 8/2013
CN 203237009 U 10/2013
CN 203511548 U 4/2014
CN 203783335 U 8/2014

(56) References Cited

FOREIGN PATENT DOCUMENTS

| | | | |
|---|---|---|---|
| CN | 204326814 | U | 5/2015 |
| CN | 103195324 | B | 6/2015 |
| CN | 204899549 | U | 12/2015 |
| DE | 4403655 | A1 | 8/1995 |
| DE | 19620059 | A1 | 11/1997 |
| DE | 19642698 | A1 | 4/1998 |
| DE | 19642698 | A2 | 11/2000 |
| DE | 10212794 | A1 | 6/2003 |
| DE | 20121915 | U1 | 11/2003 |
| DE | 10309821 | A1 | 9/2004 |
| DE | 102005041551 | A1 | 3/2007 |
| DE | 102006029774 | A1 | 1/2008 |
| DE | 102006040211 | A1 | 3/2008 |
| DE | 102006041928 | A1 | 3/2008 |
| DE | 102010052582 | A1 | 5/2012 |
| DE | 102011051165 | A1 | 12/2012 |
| DE | 102015101164 | A1 | 7/2015 |
| DE | 102014107809 | A1 | 12/2015 |
| EP | 0372791 | A2 | 6/1990 |
| EP | 0694664 | A1 | 1/1996 |
| EP | 1162332 | A1 | 12/2001 |
| EP | 1284334 | A1 | 2/2003 |
| EP | 1288403 | A2 | 3/2003 |
| EP | 1284334 | A1 | 9/2003 |
| EP | 1460204 | A2 | 9/2004 |
| EP | 1465119 | A1 | 10/2004 |
| EP | 1338731 | A2 | 2/2005 |
| EP | 1944436 | A2 | 7/2008 |
| EP | 2053744 | A2 | 4/2009 |
| EP | 2314803 | A2 | 4/2011 |
| FR | 2698838 | A1 | 6/1994 |
| FR | 2783547 | A1 | 3/2000 |
| FR | 2841285 | A1 | 12/2003 |
| FR | 2860261 | A1 | 4/2005 |
| FR | 2898632 | A1 | 9/2007 |
| FR | 2948402 | A1 | 7/2009 |
| FR | 2955604 | A1 | 7/2011 |
| GB | 2402840 | A | 12/2004 |
| GB | 2496754 | A | 5/2013 |
| JP | 52255256 | A | 11/1987 |
| JP | 05059855 | A | 3/1993 |
| JP | 406167156 | A | 6/1994 |
| JP | 406185250 | A | 7/1994 |
| JP | 2000064685 | A | 2/2000 |
| JP | 2000314258 | A | 11/2000 |
| JP | 2006152780 | A | 6/2006 |
| JP | 2007100342 | A | 4/2007 |
| JP | 2007138500 | A | 6/2007 |
| KR | 20030025738 | A | 3/2003 |
| KR | 20120108580 | A | 10/2012 |
| WO | 0123695 | A1 | 4/2001 |
| WO | 03095776 | A1 | 11/2003 |
| WO | 2013111615 | A1 | 8/2013 |
| WO | 2013146918 | A1 | 10/2013 |
| WO | 2014146186 | A1 | 9/2014 |
| WO | 2015064001 | A1 | 5/2015 |
| WO | 2015145868 | A1 | 10/2015 |
| WO | 20170160787 | A2 | 9/2017 |

OTHER PUBLICATIONS

Department of Transportation, "Federal Motor Vehicle Safety Standards; Door Locks and Door Retention Components and Side Impact Protection," http://www.nhtsa.gov/cars/rules/rulings/DoorLocks/DoorLocks_NPRM.html#VI_C, 23 pages, Aug. 28, 2010.

"Push Button to open your car door" Online video clip. YouTube, Mar. 10, 2010. 1 page.

Car of the Week: 1947 Lincoln convertible By: bearnest May 29, 2012 http://www.oldcarsweekly.com/car-of-the-week/car-of-the-week-1947-lincoln-convertible. 7 pages.

Keyfree Technologies Inc., "Keyfree," website, Jan. 10, 2014, 2 pages.

PRWEB, "Keyfree Technologies Inc. Launches the First Digital Car Key," Jan. 9, 2014, 3 pages.

George Kennedy, "Keyfree app replaces conventional keys with your smart phone," website, Jan. 5, 2015, 2 pages.

Kisteler Instruments, "Force Sensors Ensure Car Door Latch is Within Specification," Article, Jan. 1, 2005, 3 pages.

InterRegs Ltd., Federal Motor Vehicle Safety Standard, "Door Locks and Door Retention Components," 2012, F.R. vol. 36 No. 232-Feb. 12, 1971, 23 pages,.

Ross Downing, "How to Enter & Exit a Corvette With a Dead Battery," YouTube video http://www.youtube.com/watch?v=DLDqmGQU6L0, Jun. 6, 2011, 1 page.

Jeff Glucker, "Friends videotape man 'trapped' inside C6 Corette with dead battery," YouTube via Corvett Online video http://www.autoblog.com/2011/05/14/friends-videotape-man-trapped-inside-c6-corvette-with-dead-bat/, May 14, 2011, 1 page.

Don Roy, "ZR1 Owner Calls 911 After Locking Self in Car," website http://www.corvetteonline.com/news/zr1-owner-calls-911-after-locking-self-in-car/, Apr. 13, 2011, 2 pages.

Zach Bowman, "Corvette with dead battery traps would-be thief," website http://www.autoblog.com/2011/10/25/corvette-with-dead-battery-traps-would-be-thief/, Oct. 25, 2011, 2 pages.

Bryan Laviolette, "GM's New App Turns Smartphones into Virtual Keys," Article, Jul. 22, 2010, 2 pages.

Hyundai Bluelink, "Send Directions to your car," Link to App, 2015, 3 pages.

* cited by examiner

ANTI-PINCH LOGIC FOR DOOR OPENING ACTUATOR

CROSS-REFERENCE TO RELATED APPLICATION

The present application is a Continuation of U.S. patent application Ser. No. 15/269,281 entitled "ANTI-PINCH LOGIC FOR DOOR OPENING ACTUATOR," filed Sep. 19, 2016, now U.S. Pat. No. 10,458,171, which is incorporated herein by reference in its entirety.

FIELD OF THE INVENTION

The present invention generally relates to vehicle doors, and in particular to a vehicle including one or more powered door opening mechanisms and anti-pinch sensors to prevent pinching of user's hands.

BACKGROUND OF THE INVENTION

Various types of vehicle doors and door latch mechanisms have been developed. The vehicle doors may have powered door opening mechanisms. Known vehicle doors may also include powered latches that can be actuated to permit opening a vehicle door without requiring movement of an external door handle. However, known vehicle door systems may suffer from various drawbacks.

SUMMARY OF THE INVENTION

One aspect of the present disclosure is a vehicle door system including a vehicle structure having a door opening. A door having a front edge portion is rotatably mounted to the vehicle structure to close off the door opening when the door is in a closed position. The door includes a rear edge portion that is opposite the front edge portion. The system includes an anti-pinch sensor that is configured to detect a user's hand if a user's hand is positioned adjacent the door opening. The system also includes an electrically-powered door actuator that can be actuated to partially open the door by shifting the door from a closed position to a partially open position to form a gap between the rear edge portion of the door and the vehicle structure such that a user can grasp the rear edge portion and pull the door to a fully open position. The electrically-powered latch mechanism can be actuated to shift the door from the fully open position towards the closed position. The system also includes a controller that is configured to actuate the electrically-powered door actuator to prevent the door from closing if the anti-pinch sensor detects a user's hand. Actuation of the electrically-powered door actuator may include causing an electric motor of the electrically-powered door actuator to remain mechanically connected to the door without supplying electrical power to the electrically-powered door actuator such that the electric motor acts as a brake to prevent movement of the door. The controller is also configured to actuate the electrically powered actuator to shift the door from the fully open position towards the closed position.

Another aspect of the present disclosure is a vehicle door system including a door that is configured to move between open and closed positions. The system includes at least one electrically-powered actuator that is configured to open and close the door. The system also includes an anti-pinch sensor that is configured to detect a user's hand adjacent a door opening, and a controller that is configured to actuate the electrically-powered actuator to prevent closing of the door if the anti-pinch sensor detects a user's hand.

Another aspect of the present disclosure is a vehicle door system including a door and electrically-powered linear and rotary actuators. The vehicle door system also includes a pinch sensor and a controller actuates the linear actuator and then actuates the rotary actuator upon receiving an open door command. The controller also actuates the linear actuator to prevent closing of the door if the pinch sensor detects an object in a door opening. The controller also actuates the rotary actuator to close the door upon receiving a close door command.

Another aspect of the present disclosure is a vehicle door system including a vehicle structure having adjacent front and rear door openings. Front and rear doors are rotatably mounted to the vehicle structure to close off the front and rear door openings, respectively, when the doors are in closed positions. Front and rear anti-pinch sensors that are configured to detect user's hands adjacent the front and rear door openings, respectively. Front and rear electrically-powered latch mechanisms are configured to permit the front and rear doors, respectively, to open when the electrically-powered latch mechanisms are unlatched. The front and rear electrically-powered latch mechanisms retain the front and rear doors in closed positions when the electrically-powered latch mechanisms are latched. The vehicle door system also includes front and rear electrically-powered door actuators that can be actuated to shift the front and rear doors, respectively, from closed positions to open positions. A controller is configured to actuate at least one of the front and rear electrically-powered door actuators to prevent the at least one of the front and rear doors from closing if at least one of the front and rear anti-pinch sensors detects a user's hand.

These and other aspects, objects, and features of the present disclosure/invention will be understood and appreciated by those skilled in the art upon studying the following specification, claims, and appended drawings.

DETAILED DESCRIPTION OF THE PREFERRED EMBODIMENTS

Figure 1:
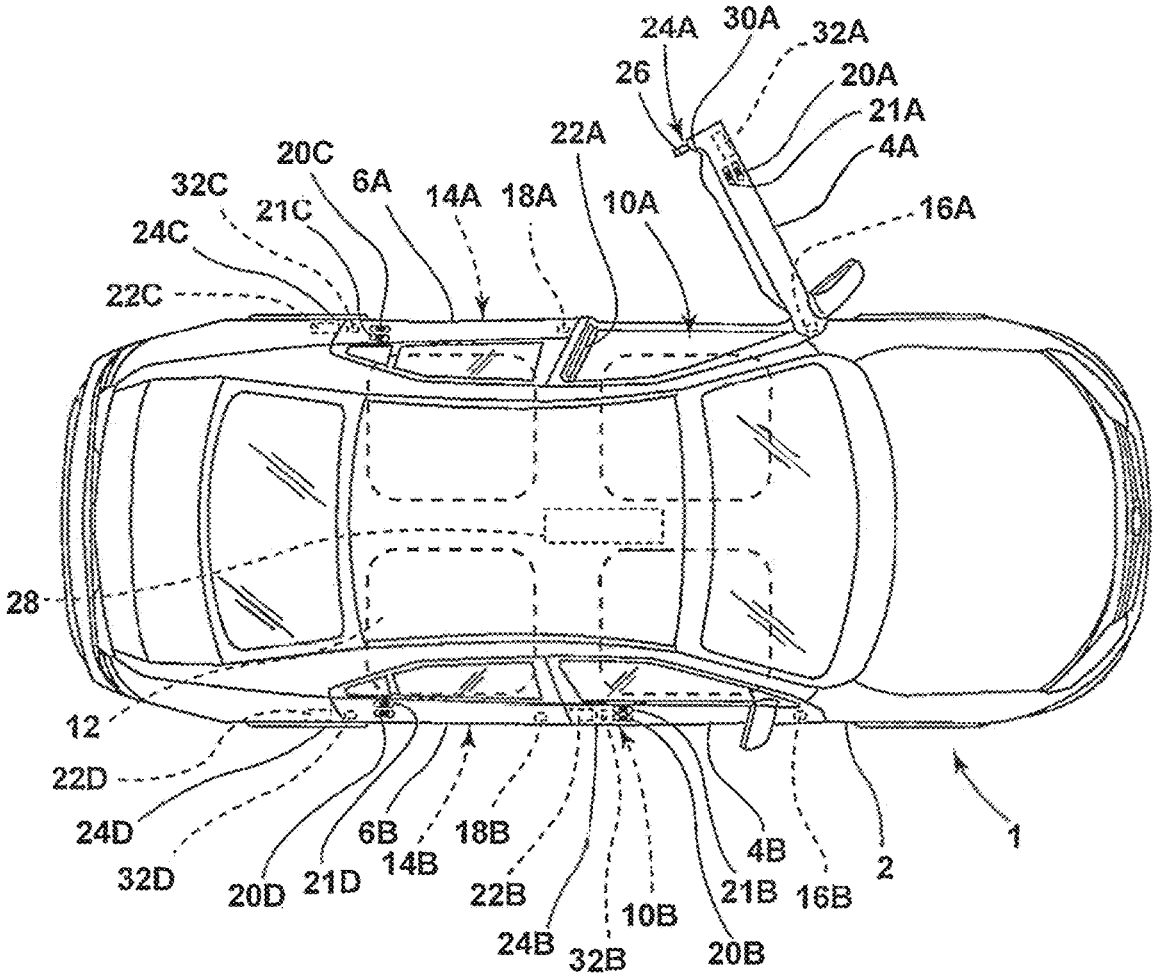
FIG. 1 is a partially schematic plan view of a vehicle including anti-pinch sensors and linear and rotary electrically-powered door actuators that open and/or close the vehicle doors.
Figure 2:
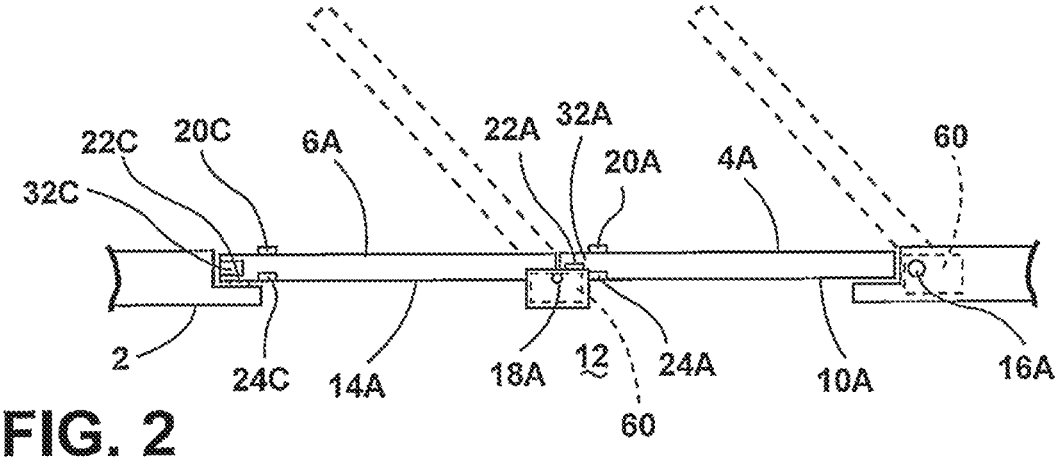
FIG. 2 is a schematic view of a portion of the vehicle of FIG. 1.

For purposes of description herein, the terms "upper," "lower," "right," "left," "rear," "front," "vertical," "horizontal," and derivatives thereof shall relate to the invention as oriented in FIG. 1. However, it is to be understood that the disclosure/invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present Application is related to U.S. Pat. No. 10,329,823, issued on Jun. 25, 2019, entitled "ANTI-PINCH CONTROL SYSTEM FOR POWERED VEHICLE DOORS," and U.S. Pat. No. 10,227,810, issued on Mar. 12, 2019, entitled "PRIORITY DRIVEN POWER SIDE DOOR OPEN/CLOSE OPERATIONS," the entire contents of each of which are being incorporated by reference.

With reference to FIG. 1, a motor vehicle 1 includes a body structure 2, front doors 4A and 4B, and rear doors 6A and 6B. The front doors 4A and 4B are configured to open and close to provide access to interior 12 of vehicle 1 through front openings 10A and 10B, respectively. Similarly, rear doors 6A and 6B are configured to open and close to provide access through rear door openings 14A and 14B. Front doors 4A and 4B are rotatably mounted to body structure 2 by hinges 16A and 16B, and rear doors 6A and 6B are rotatably mounted to body structure 2 by rear hinges 18A and 18B, respectively. In general, the doors may be opened and/or closed by powered actuators. The doors may also be manually pulled open or pushed closed by a user. As discussed in more detail below, the vehicle doors 4A, 4B, 6A and 6B may include exterior switches or sensors 20A-20B, respectively, that can be actuated by a user to generate "door open" commands to unlatch and open the vehicle doors.

Vehicle 1 further includes front and rear anti-pinch sensors 22A-22D that are configured to detect a user's hand if the user's hand is inserted into an opening 10A, 10B, 14A, 14B when a vehicle door is opened. Pinch sensors 22A-22D may comprise capacitive sensors, pressure sensitive sensors, or other suitable sensor capable of detecting a user's hand. Pinch sensors 22A-22D may be mounted to the body structure 2 adjacent the door openings. The doors 4A, 4B, 6A, and 6B include electrically-powered rotary actuators 60 (FIG. 5A) that rotate the doors to a partially or fully open position and/or close the doors. The vehicle doors 4A, 4B, 6A, and 6B may optionally include an electrically-powered linear door opener or actuator 24 that includes a plunger 26 that can be shifted linearly to a first extended position to partially open the doors (see also FIG. 7). It will be understood that hydraulic, pneumatic, or other types of powered mechanisms may be utilized in linear powered actuator 24 and rotary powered actuator 60. The doors 4A, 4B, 6A, and 6B also include electrically-powered latch mechanisms 32A-32D. Powered latch mechanisms 32A-32D retain the doors in closed positions when in a latched configuration, and permit opening of the doors when in unlatched configurations. The powered latches 32A-32D can be actuated by an Electronic Control Unit ("ECU") such as controller 28 to unlatch the doors if unlatch switches 20A-20D, respectively, are actuated by a user. The powered latches 32A-32D may define locked and unlocked states such that powered latches 32A-32D will not unlatch unless they are in an unlocked state. The locked and unlocked states may be electronic (e.g. a stored state or flag in controller 28), and the powered latches 32A-32D may be unlocked if the vehicle's security system detects an authorized fob near the vehicle 1. Alternatively, a user may enter a security code ("PIN") utilizing a touchpad or keypad (not shown) to unlock the powered latches 32A-32D, or the vehicle may include a fingerprint reader (not shown) or other system/device to permit authorized users to unlock the powered latches 32A-32D.

The controller 28 may be operably connected to the anti-pinch sensors 22A-22D, powered door opening mechanisms 24A-24D, and powered latches 32A-32D. Controller 28 may comprise a single central controller as shown in FIG. 1, or controller 28 may comprise separate controllers that are located in each door 4A, 4B, 6A, and 6B. The powered door opening mechanisms 24A-24D and powered latches 32A-32D are described in more detail in copending U.S. Pat. No. 10,227,810.

As discussed in more detail below, to enter vehicle 1 a user pushes release switch 20A which is operably connected to a controller 28. Controller 28 then unlatches the powered latch 32A (provided the door/latch is unlocked) and actuates the linear powered door opening mechanism 24 to thereby cause the plunger 26 to shift to an extended ("first check") position to thereby at least partially open door 4A whereby rear edge 30A of door 4A is spaced apart from vehicle body 2. A user may then grasp edge 30A and pull door 4A to a fully open position. The other doors 4B, 6A, and 6B may be opened in a substantially similar manner. Doors 4A, 4B, 6A, 6B may also include electrically-powered rotary actuators 60 (FIGS. 2, 3, 6, 7 and 8) that rotate the doors from the first check position (or a second check position) to a fully open position. Electrically-powered rotatory actuators 60 may also rotate the doors from an open position back to a closed position. Doors 4A, 4B, 6A, 6B may include both linear powered actuators 24 and rotary powered actuators 60. Alternatively, the doors may include only rotary actuators 60. The powered door opening mechanisms 24 and/or 60 eliminates the need for external vehicle door handles that would otherwise be required to permit a user to grasp the door handle to pull the door open.

Opening and closing of the driver's side front and rear doors 4A and 6A is shown schematically in FIGS. 2-8. It will be understood that the passenger side doors 4B and 6B operate in a substantially similar manner as driver's side doors 4A and 6A. In use, a user initially actuates a sensor or switch 20A or 20C to generate an unlatch or open request/command to controller 28. For example, if a user actuates/pushes the unlatch ("open command") sensor/switch 20A, controller 28 generates a signal to powered latch 32A of front door 4A to thereby cause powered unlatching of latch 32A. Similarly, if unlatch (open) sensor/switch 20C is actuated, controller 28 generates a signal to unlatch powered latch 32C of rear door 6A. If vehicle 1 is equipped with linear actuators 24, after the powered latch 32A or 32B is unlatched, controller 28 then generates a signal to the linear powered actuator 24A or 24C, causing plunger 26 to extend and push door 4A or 6A to a partially opened position. A user then grasps rear edge 30A or 30C of door 4A or 6A to pull the door to a fully open position. As a user grasps the edge 30A or 30C, anti-pinch sensors 22A or 22C generate a signal to controller 28 indicating that a user's hand is present. Controller 28 may then generate a signal to retain the plunger 26 in an extended position to prevent pinching of a user's hand.

Alternatively, if vehicle 1 is only equipped with rotary actuators 60 (i.e., vehicle 1 does not include linear actuators 24), after the unlatch/open sensor/switch 20 is actuated, controller 28 actuates rotary actuator 60 to rotate the door to a partially or fully open position after the powered latch 32 is unlatched. If the door is rotated to a fully open position by rotary actuator 60, a user does not need to pull the door to the fully open position.

Figure 3:
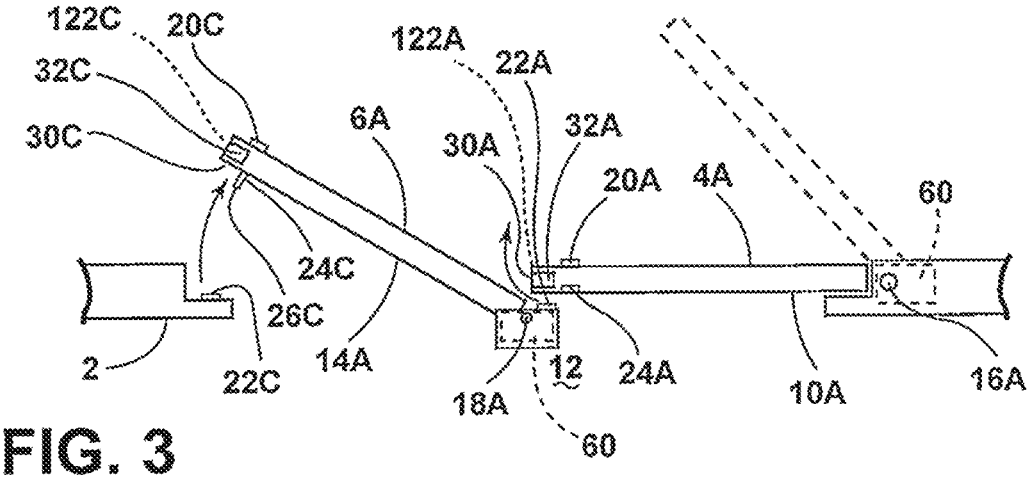
FIG. 3 is a schematic view of a portion of the vehicle of FIG. 1.

Referring to FIG. 3, when rear door 6A is opened and front door 4A remains closed, a user may nevertheless insert a hand and grasp rear edge 30A of front door 4A. If rear door 6A were to be closed this could pinch a user's hand positioned adjacent front pinch sensor 22A. As discussed in more detail below in connection with FIGS. 9A, 9B, 10A, and 10B, controller 28 may be configured/programmed to actuate linear actuators 24 and/or rotary actuators 60 to prevent pinching if the front door 4A is closed while the rear door 6A is open. As shown in FIG. 3, anti-pinch sensors 122A, 122C, etc. may optionally be mounted to the vehicle doors 4A, 6A adjacent the rear edges 30A, 30C, etc. rather than to the vehicle body.

Figure 4:
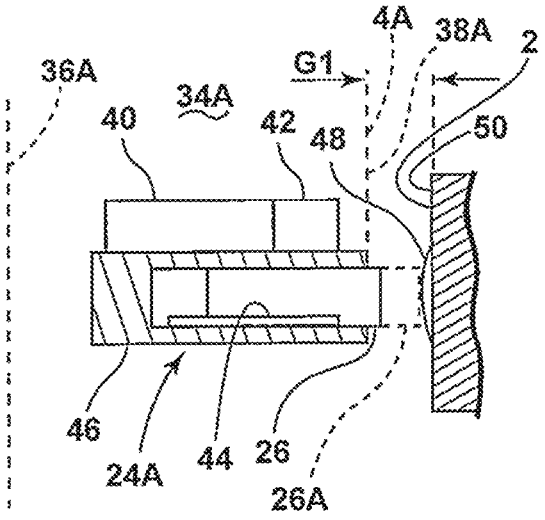
FIG. 4 is a schematic view of an electrically-powered linear door actuator in a first check position.
Figure 5:
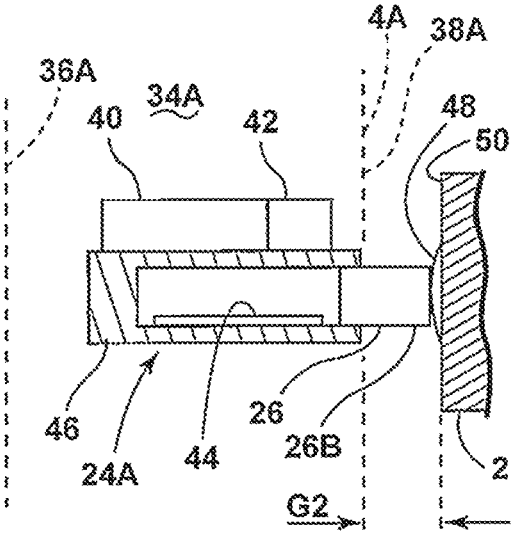
FIG. 5 is a schematic view of an electrically-powered linear door actuator in a second check position.

With reference to FIGS. 4 and 5, the doors 4A may optionally include a linear electrically-powered door opening mechanism 24A that is disposed in an interior space 34A of door 4A between outer side 36A and inner side 38A of door 4A. All doors of the vehicle 1 may include powered door opening mechanisms 24 that are substantially similar to the mechanism 24A. Mechanism 24A may include a housing or base structure 46 and a plunger 26 that is movably interconnected with the housing 46 for reciprocating movement relative to the housing 46. The mechanism 24A may include an electric motor 40 and gear drive 42 that provide for powered movement of plunger 26 between a retracted position and one or more extended positions. A sensor 44 enables controller 28 to determine the position of plunger 26 relative to housing 46. The components of powered actuator 24A are shown schematically in FIGS. 4 and 5. It will be understood that the powered door opening mechanism 24A may have various configurations as required for a particular application. For example, the powered door opening mechanism 24 may be configured as disclosed in copending U.S. Pat. No. 10,227,810.

Plunger 26 may be actuated to extend to a first check position 26A (FIG. 4), causing door 4A to open to a first partially open position (see also FIG. 7) whereby a gap "G1" is formed between inner surface 38A of door 4A and surface 50 of vehicle body 2. A pad or surface 48 may be disposed on surface 50 of body 2 in the region where plunger 26 contacts surface 50 of vehicle body 2. As shown in FIG. 5, the plunger 26 may be further extended to a fully extended position 26B that is slightly further extended than position 26A of FIG. 4. Plunger 26 may be shifted to the fully extended position 26B to cause the door to shift to a first check position having a gap "G2" that is slightly greater than gap G1. Actuator 24 may be actuated to shift plunger 26 directly to position 26B to move the door to a first check position having a gap G2. In general, the gap G2 of the first check position is sufficiently large to ensure that pinching does not occur. Actuator 24 can be actuated by controller 28 to maintain plunger 26 in position 26B to ensure that the vehicle door does not close on a user's hand. Plunger 26 may shift to fully extended position 26B after door 4A has been shifted to a fully open position (e.g. pulled open by a user). Controller 28 may be configured to detect travel of plunger 26 to fully extended position 26B, and utilize the position 26B as an indication that the door has been shifted to a fully open position. Alternatively, door hinges 16A, 18A, etc., and/or rotary actuators 60 may include a position sensor (not shown) that detects the angular positions of the doors such that controller 28 can determine when the doors are fully open utilizing data from rotary actuators 60. In general, the gap G2 may be about one to about four inches.

Figure 5A:
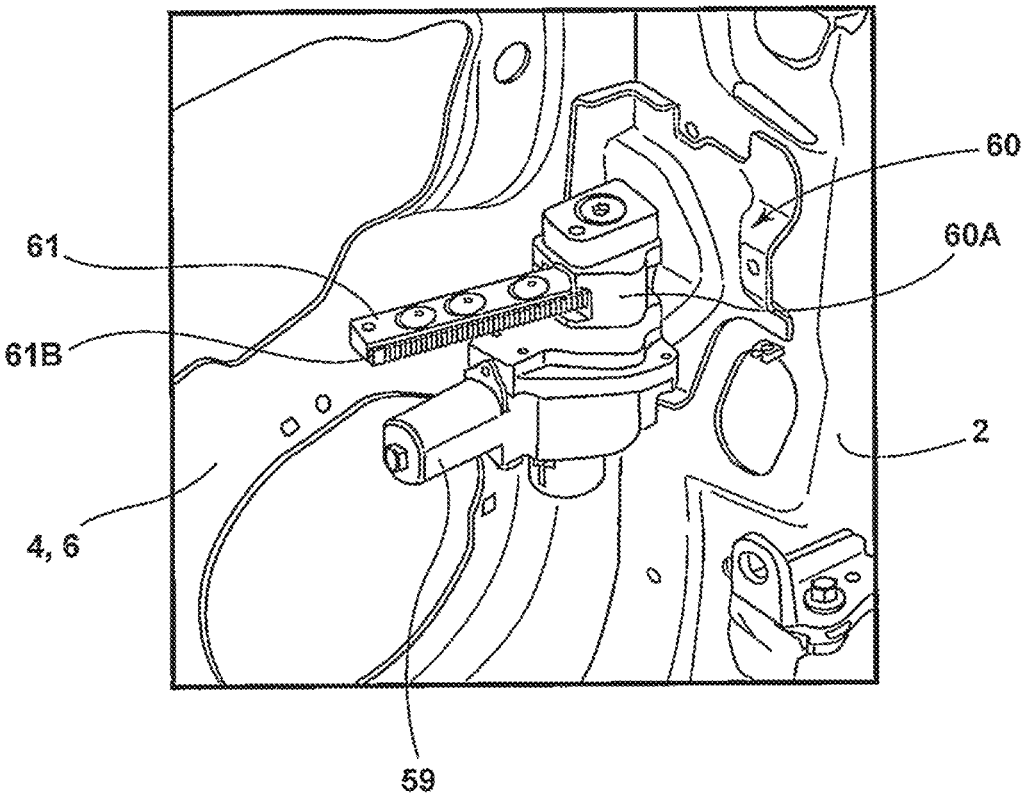
FIG. 5A is a partially fragmentary isometric view of an electrically-powered rotary door actuator.

With reference to FIG. 5A, electrically-powered rotary actuator 60 may include an electric motor 59 that is operably connected to a strap 61 by a gear drive 61A including a linear gear rack 61B mounted on a strap 61. Electrically-powered rotary actuator 60 includes rotary and/or linear sensors (not shown) that sense (measure) the position of electric motor 59 and/or strap 61 and provide position data concerning the angular position of doors 4, 6 relative to vehicle body 2 to controller 28. Controller 28 is operably connected to electric motor 14 and selectively actuates electric motor 14 to open and close doors 4, 6. Gear drive 61A of electrically-powered rotary actuator 60 may include a mechanism (not shown) that selectively disconnects electric motor 59 from strap 61 such that strap 61 can move freely without rotating electric motor 59. The mechanism may comprise a clutch or other suitable mechanism that includes an electrically-powered actuator (e.g. solenoid) that can be actuated to disengage the electric motor 59 from gear drive 61A such that the door can be opened/closed freely. If the clutch is engaged (i.e. gear rack 61B is mechanically connected to electric motor 59 by gear drive 61A) but electric power is not supplied to electric motor 59, a relatively large force must be applied to move the door and back drive electric motor 59. This will tend to retain the door in a fixed position (open or partially open) to prevent pinching. Nevertheless, if the clutch is engaged, a user can still grasp the door and apply sufficient force to back drive electric motor 59 and pull the door open or push the door closed. Controller 28 and electrically powered actuator 60 may be configured such that a relatively large opening force acting on the door is detected by controller 28, and controller 28 may be configured to interpret this as an "open door" command and provide electrical power to electric motor 59 to open the door and/or cause the clutch to disengage to permit the door to open freely without back driving electric motor 59. Controller 28 may also be configured to interpret back driving of electric motor 59 (i.e. rotation of electric motor 59 when no electric power is supplied to electric motor 59) in open and/or closed directions as "open door" and "close door" commands, respectively.

Gear drive 61A and electric motor 59 may also be configured such that a force applied to the door while the clutch is engaged does not (cannot) result in back driving of electric motor 59. For example, gear drive 61A may comprise a worm gear arrangement that is non-back drivable. If gear drive 61A is configured in this way, electric motor 59 acts as a brake that prevents rotation of the door when the clutch is engaged and no electric power is supplied to electric motor 59. Also, the clutch may include a spring (not shown) that biases the clutch to an engaged position such that electric power must be supplied to an actuator (e.g. solenoid) to disengage the clutch. Conversely, the clutch may include a spring or the like that biases the clutch to a disengaged position such that a powered actuator must be actuated to engage the clutch. In general, for both back drivable and non-back drivable gear drives 61A, when the clutch is engaged the electric motor 60 generates a force tending to prevent closing of the door to thereby provide an anti-pinching feature or function. Also, electric power tending to open the door may also be supplied to electric motor 60 by ECU 28 while the clutch is engaged to cause electric motor 60 to generate a force tending to prevent closing of the door to provide an anti-pinch feature or function.

Figure 6:
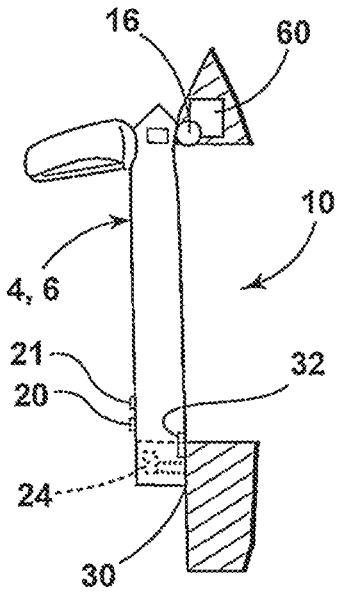
FIG. 6 is a schematic plan view of a vehicle door in a closed position.
Figure 7:
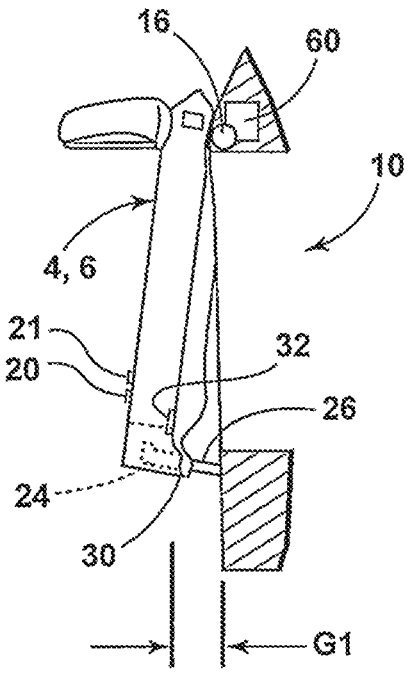
FIG. 7 is a schematic plan view of a vehicle door in a partially opened first check position.
Figure 8:
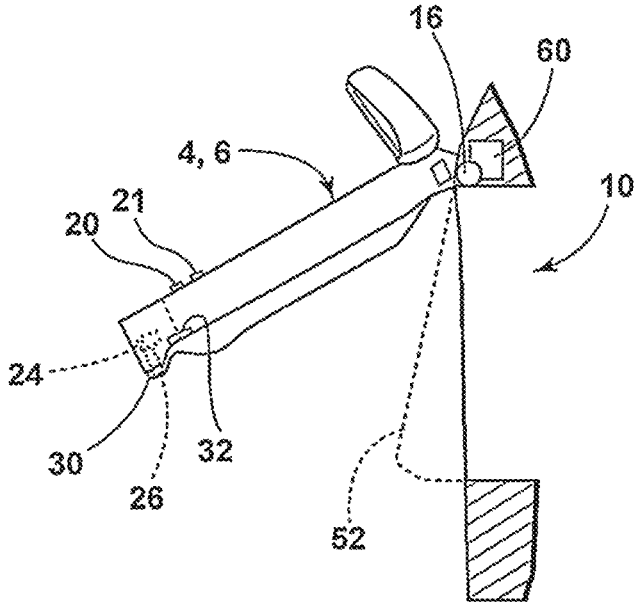
FIG. 8 is a schematic plan view of a vehicle door in a fully open position.

With further reference to FIGS. 6-8, a user initially actuates unlatch/open switch or sensor 20A when door 4 or 6 is in a closed position (FIG. 6). Controller 28 then unlatches the powered latch 32. If the door includes a linear powered actuator 24, the controller 28 actuates linear powered door opener 24 to extend plunger 26 to a first check (distance P1) position in which door 4 or 6 is in a first partially opened position creating a gap G1 as shown in FIG. 7. A user may then grasp edge 30 of door 4 and pull the door to a fully open position shown in FIG. 8. Alternatively, controller 28 actuates rotary actuator 60 to rotate the door from the first check position to the fully open position. If the door does not include a linear powered actuator 24, controller 28 unlatches powered latch 32 upon actuation of sensor 20, and controller 28 then actuates rotary actuator 60 to rotate the door 4 or 6 to a first or second check position or to the fully open position (FIG. 8). Controller 28 retracts the plunger 26 when the door is in a fully open position (FIG. 8), and the powered latch 32 is then reset. A user may then manually close the door by pushing the door 4 from the open position (FIG. 8) to the closed position (FIG. 6). Powered latch 32 then retains the door 4A in the fully closed position (FIG. 6). Alternatively, a user may actuate "close" switch or sensor 21 to generate a "close" signal to controller 28, and controller 28 then actuates rotary actuator 60 to rotate the door from an open position to a closed position. Powered latch 32 may comprise a cinching door latch. For example, the claw 180 of the powered latch described in the U.S. Pat. No. 10,227,810 may be operably connected to a powered actuator (e.g. electric motor) whereby the claw rotates from an open/released position to a latched/closed position to engage a striker to pull the door to a fully-closed position. If the powered latch 32 is a cinching door latch, door may be initially moved by a user or by actuator 60 to a mostly closed position 52 (FIG. 8), and the powered latch 32 may then be actuated to shift the door to the fully closed position of FIG. 6. Cinching latch mechanisms are disclosed in U.S. Pat. No. 9,004,570, issued on Apr. 14, 2015 and entitled "ADJUSTABLE LATCH ASSEMBLY," and U.S. Pat. No. 9,951,547, issued on Apr. 24, 2018 and entitled "ADJUSTABLE DECKLID LATCH ASSEMBLY," the entire contents of each being incorporated herein by reference. Cinching door latches are generally known in the art, and a detailed description of a cinching door latch is therefore not believed to be necessary. It will be understood that all of the doors 4A, 4B, 6A, and 6B of vehicle 1 may operate in substantially the same manner as the doors shown and described above in connection with FIGS. 2-8.

Figure 9A:
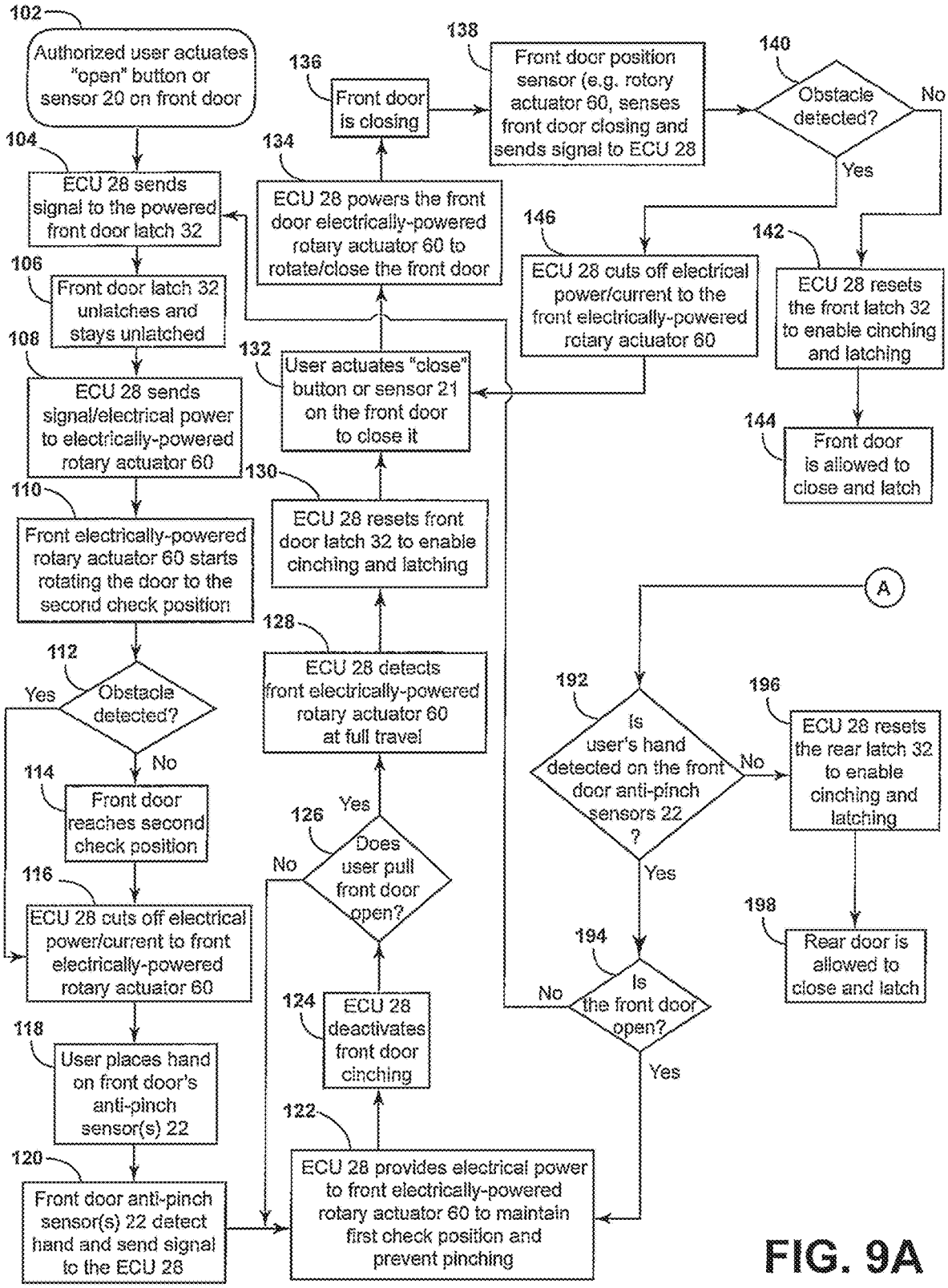
FIG. 9A is a first portion of a flow chart showing operation of front and rear vehicle doors that include an electrically-powered rotary actuator that opens and closes the vehicle doors.
Figure 9B:
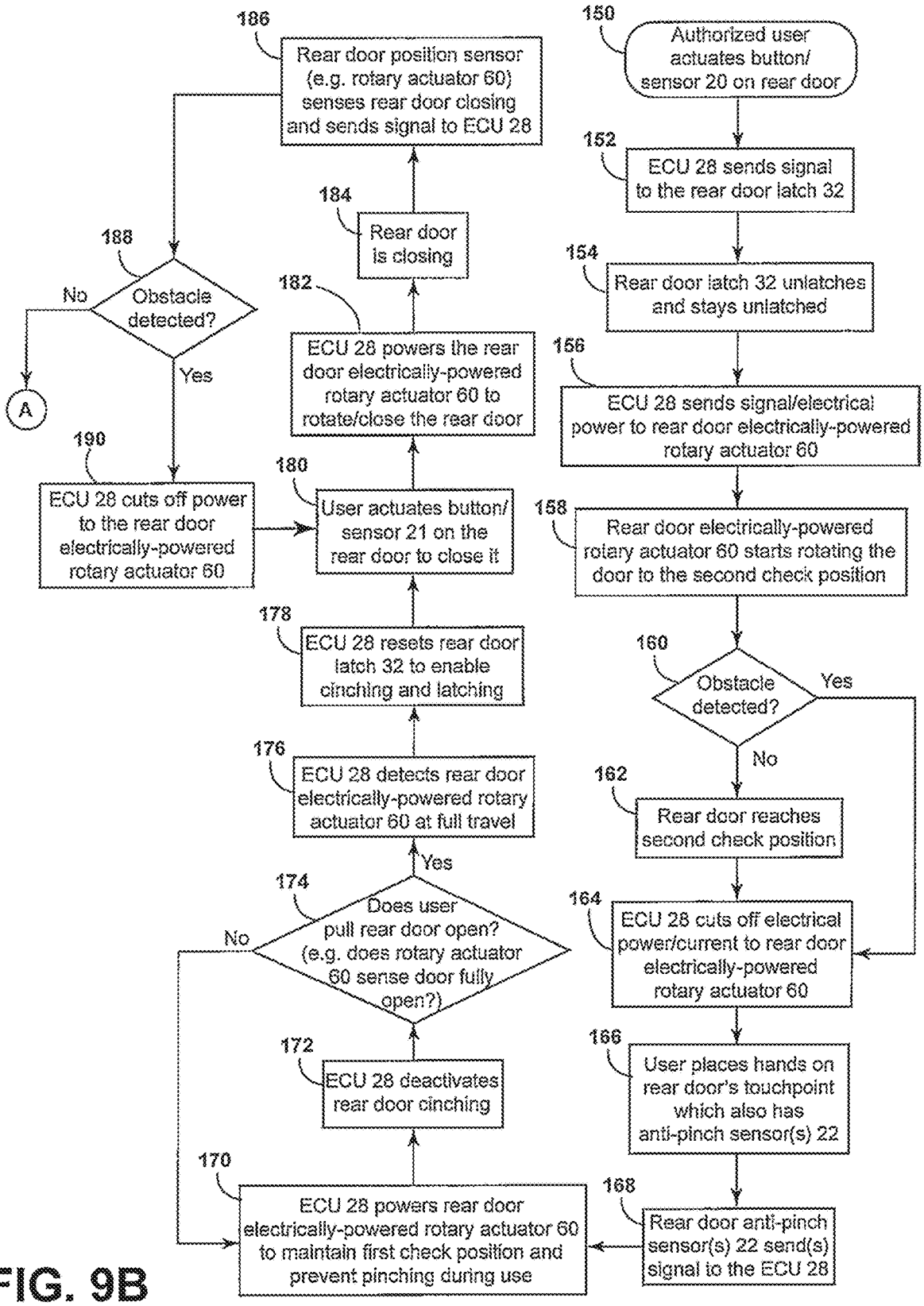
FIG. 9B is a second portion of the flow chart of FIG. 9A.

FIGS. 9A and 9B are first and second portions, respectively, of a flow chart showing operation of a vehicle door system that includes an electrically-powered rotary actuator 60, but does not include an electrically-powered linear actuator 24. The process for opening a vehicle front door begins at step 102 (FIG. 9A), and the process for opening a rear vehicle door begins at step 150 (FIG. 9B).

Referring to FIG. 9A, at step 102 a user actuates the open sensor/button 20 on the front door of the vehicle to generate an "open door" command signal to controller 28. It will be understood that the sensor 20 may comprise a push button or other manually-actuated switch, or it may comprise a proximity sensor. Also, the security system of the vehicle 1 (e.g., ECU 28 and/or other components) may be configured to permit opening of the vehicle doors only if an authorized user is detected. For example, a vehicle 1 may include a passive entry passive start (PEPS) system that detects the presence of a wireless fob carried by a user. If an authorized fob is detected, the system may shift to an authorized or unlocked state in which the powered latches 32 can be unlatched. The security system may be configured to require both detection of an authorized fob and actuation of a proximity sensor (e.g., an "unlock" proximity sensor that is positioned on an outer surface of a vehicle door in addition to the switches or sensors 20, 21) to unlock the vehicle doors to permit unlatching and opening of the vehicle doors.

As shown at step 104, if the ECU 28 determines that an authorized user (e.g. wireless fob) has been detected to thereby authorize/unlock the door, and if the open (unlatch) sensor 20 is actuated, the ECU 28 sends a signal to the powered front door latch 32 to unlatch the front door latch 32 as shown at step 106. As shown at steps 108 and 110, the ECU 28 then sends a signal to the electrically-powered rotary actuator 60, and the electrically-powered rotary actuator 60 starts rotating the door to a second check position. The term "second check position" as used in FIGS. 9A and 9B generally corresponds to a fully open position (e.g. FIG. 8). However, the second check position could alternatively be an open position in which the door is more open than the first check position (e.g. FIG. 5), but not fully open.

As shown at step 112 and 116 (FIG. 9A), if an obstacle is detected the ECU 28 cuts off electrical current to the electrically-powered rotary actuator 60 before the door reaches the second check position to stop movement of the door. The clutch of electrically-powered rotary actuator 60 may, however, remain engaged at step 112 such that a user must apply a significant force on the door to rotate the door and backdrive the electric motor 59, to provide an anti-pinch safety feature.

As discussed above in connection with FIG. 5A, the electrically-powered rotary actuator 60 may include an electric motor 59 (e.g., stepper motor) and a rotary position sensor. The ECU 28 may be configured to provide electrical power (electric current) to the electrically-powered rotary actuator 60 to open the door at a known rate, and the ECU 28 may be configured to increase or decrease electrical current supplied to the rotary actuator 60 to maintain a constant angular velocity of the door during opening and/or closing operations. If the door encounters an object that impedes opening of the door, the door will typically slow (or stop) rotation relative to an expected rotation rate for a given amount of electrical power supplied to the rotary actuator 60. The ECU 28 may be configured to limit the electrical current supplied to the rotary actuator 60 to a predefined maximum to prevent damage. Also, ECU 28 may be configured to interpret a sudden increase in voltage to maintain a target velocity and/or reduced (or zero) angular velocity at constant or increasing electrical current as indicating that an object has been encountered by the door. Proximity sensors or the like (not shown) may also be utilized to detect objects in the path of the door. Proximity sensors may be utilized to detect objects before the door contacts the object, and ECU 28 may be configured to stop actuation of electrically-powered rotary actuator 60 before the door contacts an object.

As shown at steps 112 and 114 (FIG. 9A), if an obstacle is not detected, the ECU continues to supply electric power to electrically powered rotary actuator 60 and the front door will rotate to the second check (fully open) position, and the ECU 28 will then cut off electrical current to the rotary actuator 60. When the door reaches the fully open position, ECU 28 may (optionally) disengage the clutch of electrically-powered rotary actuator 60 to permit the door to be manually closed without backdriving electric motor 59.

As shown at steps 118, 120, 122, if a user places a hand on the anti-pinch sensors 22 of a front door after the door has moved to the second position, the ECU 28 may provide electrical power to the front electrically-powered rotary actuator 60 to cause electrically-powered rotary actuator 60 to rotate the door to a fully open position. Alternatively, at step 122 the ECU 28 may cut off electric power to electrically-powered rotary actuator 60 while causing the clutch of electrically-powered rotary actuator 60 to remain engaged such that an external force on the door will not move the door unless the force is sufficient to back drive the electric motor 59 of electrically-powered rotary actuator 60.

The controller 28 may be configured to provide power to front electrically-powered rotary actuator 60 to rotate the front door to a partially open position (FIG. 4), or to a first check position (FIG. 5). Alternatively, controller 28 and electrically-powered rotary actuator 60 may be configured to rotate the door to a fully open second check position (e.g., FIG. 8). If the controller 28 and rotary actuator 60 are not configured to rotate the door to a fully open second check position, the ECU 28 determines at step 126 if the door has reached a fully open position due to a user pulling the front door to a fully open position, or due to actuation of electrically-powered of rotary actuator 60 by ECU 28. At step 126, ECU utilizes the door sensor position of rotary actuator 60 to determine if the door is open. If the door is not open at step 126, the process returns to step 122, and the ECU 28 powers the actuator 60, or actuates the clutch/brake of electrically-powered rotary actuator 60 without supplying electric power to electric motor 59 of electrically-powered rotary actuator 60 to prevent closing of the door. However, if the door has been a fully opened, at step 130 the ECU 28 resets the front door latch 32 to enable cinching and latching. It will be understood that the door latch 32 may comprise a powered cinching latch, or it may comprise a powered latch that does not have a cinching function. If the door latch 32 does not have a powered cinching feature, the ECU 28 does not enable cinching at step 130.

As shown at step 132 (FIG. 9A), if a user actuates the close switch/button/sensor 21 on the front door to generate a "close door" request, the process continues to step 134. Alternatively, at step 132, if the clutch of electrically-powered rotary actuator 60 is engaged and a user pushes on the front door (i.e. starts to backdrive electric motor 59 of electrically-powered rotary actuator 60), ECU 28 may construe this as a "close door" request. In response to this close door request, the ECU may disengage the clutch of electrically-powered rotary actuator 60 to permit the front door to close freely, or ECU 28 may actuate electrically-powered rotary actuator 60 to close the door. At step 134, the ECU 28 provides electrical power to the rotary actuator 60 to rotate the front door to a closed position, and the door rotates as shown at step 136. As the front door is closing, the position sensor (e.g., rotary actuator 60) senses the door closing and provides a signal to the ECU 28. As discussed above in connection to step 112, the ECU 28 may utilize data from rotary actuator 60 to determine if an object has been encountered by the door. As shown as step 146 (FIG. 9A), the ECU cuts off electrical power/current to the front rotary actuator 60 if an object is detected, and the process then returns to step 132. If an object is not detected at step 140, the process continues to 142 and the ECU 28 resets the front latch 32 to enable cinching and latching. The front door then closes as shown at step 144.

The rear door operation (FIG. 9B) shown at steps 150-186 generally corresponds to front door operation (steps 102-140 of FIG. 9A). Step 170 may include substantially the same operations with respect to rear electrically-powered rotary actuator 60 as discussed above in connection with step 122 and front electrically-powered rotary actuator 60.

However, the rear door operation is not identical to front door operation. Specifically, at step 188 (FIG. 9B), if an object is not detected, the process returns to step 192 (FIG. 9A). The system (ECU 28) then determines at step 192 if a user's hand is on the front door anti-pinch sensors 22. If not, at steps 196 and 198 the ECU 28 resets the rear latch and the rear door is allowed to close and latch. However, if a user's hand is detected on the front door anti-pinch sensor 22 at step 192, the process then continues to step 194. If the front door is open, the process continues at step 122 as described above. If the front door is not open at step 194, the process continues to step 104 as described above.

Thus, it can be seen that the rear door does not close unless a user's hand on the front door is not detected at step 192. This prevents pinching if a user were to position a hand along the rear edge of a closed front door (FIG. 3) while the adjacent rear door 6A is open. If a user's hand were to be positioned along the rear edge 30A of the front door 4A while the rear door 6A is open (FIG. 3), and if the rear door 6A were then to be closed (FIG. 2), a pinch condition could result. The process shown at steps 192, 194, and 122 of FIG. 9A prevents this pinching situation.

Figure 10A:
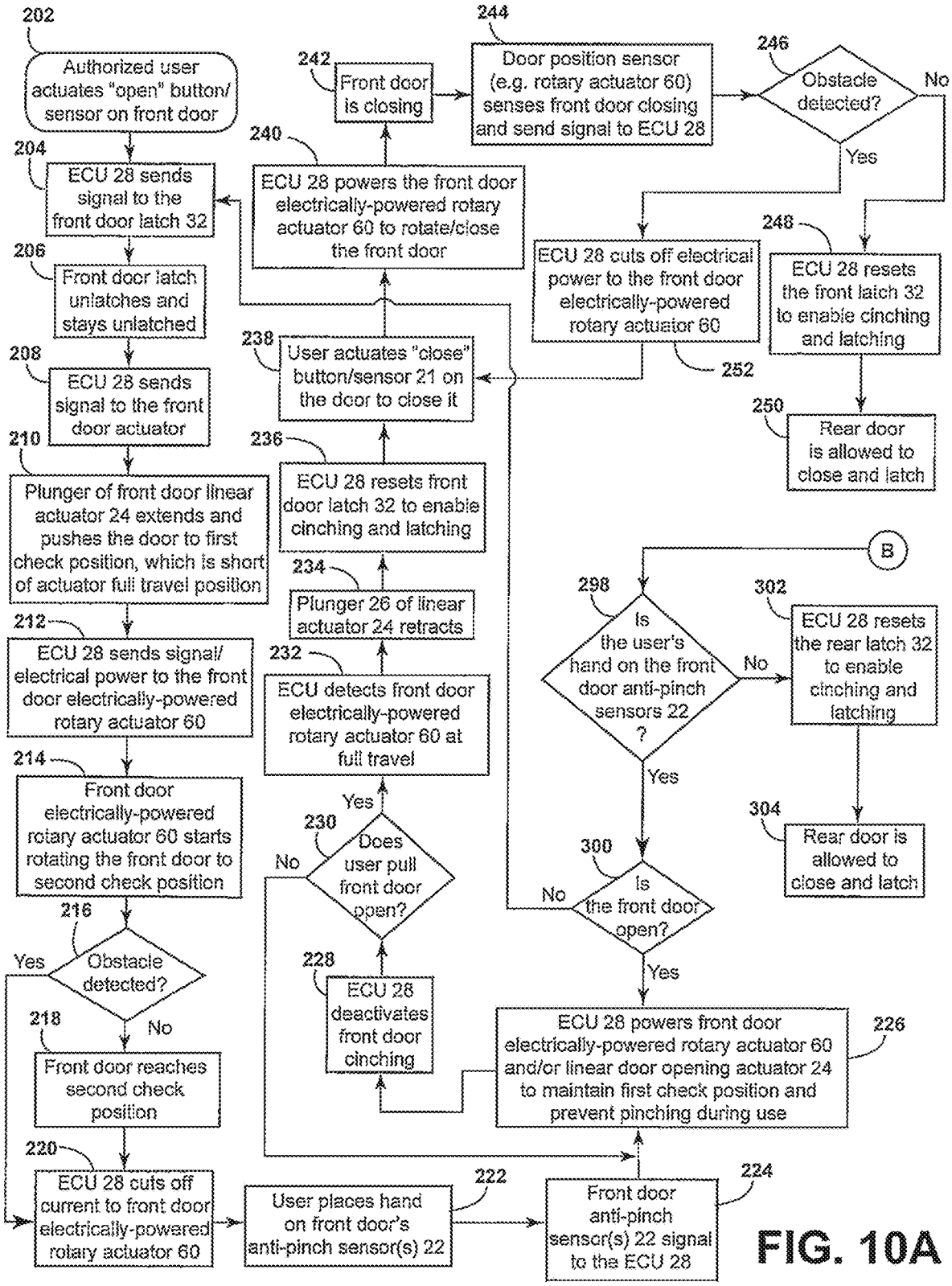
FIG. 10A is a first portion of a flow chart showing operation of front and rear vehicle doors that include an electrically-powered rotary actuator and an electrically-powered linear actuator.
Figure 10B:
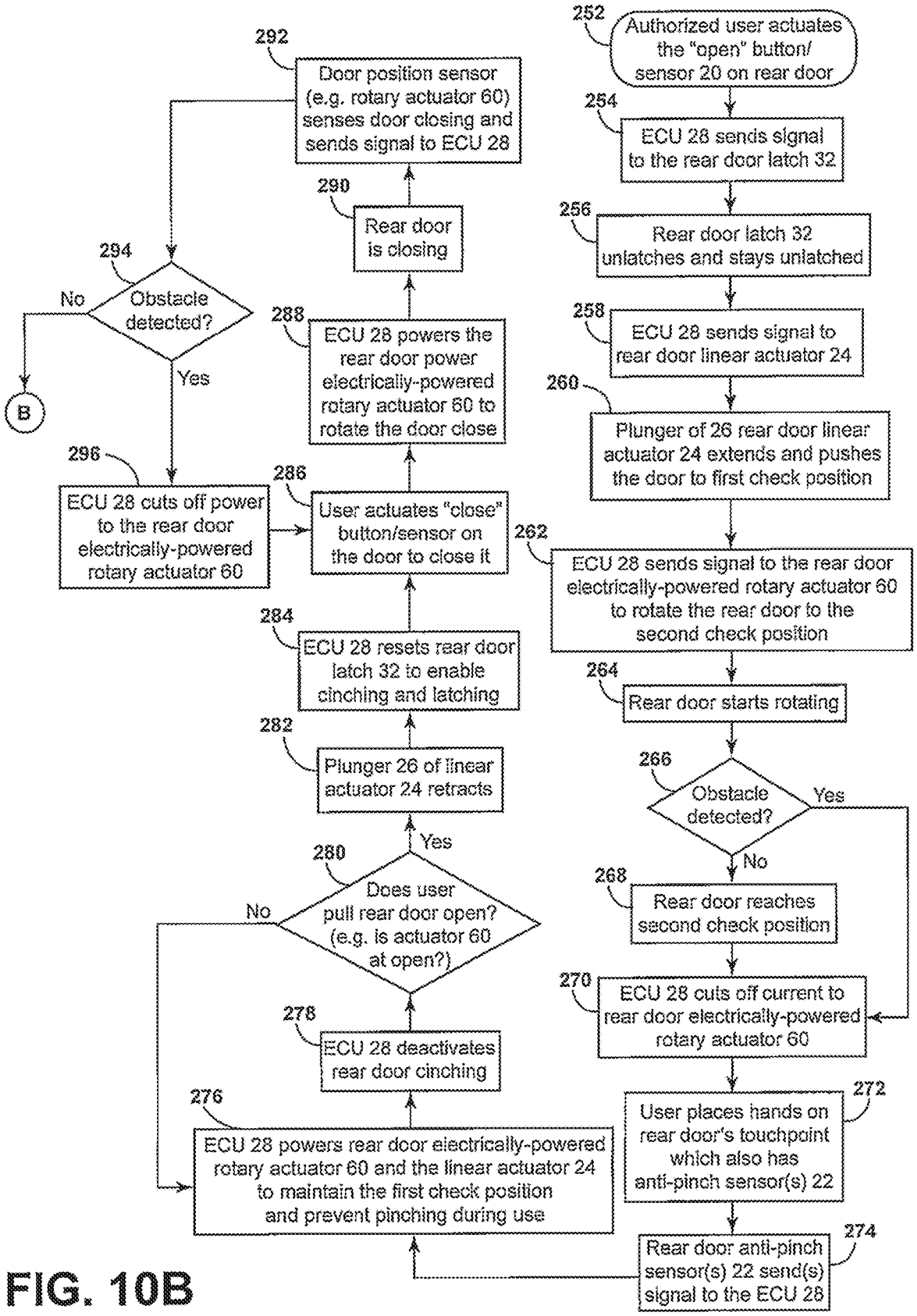
FIG. 10B is a second portion of the flow chart of FIG. 10A.

FIGS. 10A and 10B are first and second portions, respectively, of a flow chart showing operation of a vehicle door system including both linear electrically-powered actuators 24 and electrically-powered rotary actuators 60. Operation of the front door begins at step 202 (FIG. 10A) and operation of the rear door begins at step 252 (FIG. 10B).

Steps 202-210 generally correspond to steps 102-110 of FIG. 9A. However, at step 210, the plunger of linear actuator 24 is extended to push the door to a first check position, and the ECU 28 then sends a signal to the rotary actuator 60 as shown at step 212. The rotary actuator 60 then starts rotating the front door to the fully open second check position as shown in step 214. If an object is detected at step 216, the ECU cuts off electrical current (power) to the front rotary actuator 60 as shown at step 220 to prevent further opening of the door. If an object is not detected at step 216, the front door rotates to the fully open second check position as shown at step 218. As shown at steps 222, 224 and 226, a user then places a hand on the front door anti-pinch sensors 22, and the ECU 28 powers the rotary actuator 60 and/or the linear actuator 24 to maintain the door at a first check position to prevent pinching.

At step 228, the ECU 28 activates the front door cinching. At step 230, the ECU determines if a user has pulled the front door to an open position utilizing, for example, sensors of rotary actuators 60. If a user has not pulled a door open at step 230, the process returns to step 226. However, if a user has pulled a front door open at step 230 utilizing rotary actuator 60 (Step 232), the ECU 28 then retracts plunger 26 of linear actuator 24 as shown at step 234 to permit the door to be closed.

As shown at step 238, a user then actuates the close button/sensor 21 on the door to generate a "close door" command/request to ECU 28 to close the door. The ECU 28 then powers the rotary actuator 60 to close the front door as is shown in step 240. As shown at steps 242 and 244, as the front door is closing, the ECU 28 receives a signal from rotary actuator 60 concerning the position of the door. If an object is detected at step 246, the ECU 28 cuts off electrical current (power) to the rotary actuator 60 as shown at step 252 to stop the door. As discussed above, ECU 28 may monitor the power and position of actuator 60 to determine if an object has been encountered by the door.

If an object is not detected at step 246, the ECU 28 resets the front latch 32 as is shown at step 248, and the rear door is allowed to close and latch as shown at step 250.

Referring to FIG. 10B, rear door open operation begins at step 252. Steps 254-286 of rear door operation (FIG. 10B) generally correspond to steps 204-238, respectively of the front door operation (FIG. 10A), such that a detailed description of these steps is not believed to be necessary. Similarly, steps 288, 290, 292, and 294 (FIG. 10B) are substantially similar to steps 240, 242, 244, and 246, respectively of FIG. 10A. If an object is detected at step 294, the ECU 28 cuts off electrical current (power) to the rear door rotary actuator 60 as shown at step 296 to stop movement of the door, and the process then returns to step 286. However, if an object is not detected at step 294 (e.g., the ECU 28 determines that rotary actuator 60 is not closing the door and/or a sudden increase in electrical power to the rotary actuator 60 occurs) the process returns to step 298 (FIG. 10A). At step 298, the ECU 28 determines if a user's hand is on the front door anti-pinch sensor 22. If the front door is open and a user's hand is on the front door anti-pinch sensor 22, the process continues to step 226 and the rotary actuator 60 and/or the linear actuator 24 are actuated to prevent closing of the front door. This prevents pinching that could otherwise occur if a user's hand were to be placed on rear edge 30A (FIGS. 2 and 3) of front door 4A while rear door 6A is open and then closed. If a user's hand is not detected on the front door anti-pinch sensors 22 at step 298, the ECU 28 resets the powered latch 32 (FIG. 2) and the rear door is allowed to close and latch (step 304).

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door system, comprising:

a vehicle structure having a door opening;

a door having an edge including a front edge portion that is rotatably mounted to the vehicle structure by a hinge assembly to close off the door opening when the door is in a closed position, the edge of the door further including a rear edge portion that is opposite the front edge portion;

an anti-pinch sensor that is configured to detect a user's hand when the user's hand is positioned adjacent the door opening alone, adjacent the edge of the door alone, or adjacent the door opening and the edge of the door taken together;

an electrically-powered rotary door actuator that is configured to rotate the door about the hinge assembly, wherein the electrically-powered rotary door actuator can be actuated to partially open the door by shifting the door from a closed position to a partially open position to form a gap between the rear edge portion of the door and the vehicle structure such that a user can grasp the rear edge portion and pull the door to a fully open position, and wherein the electrically-powered rotary door actuator can be actuated to rotate the door from the fully open position towards the closed position; and a controller configured to: 1) cause the electrically-powered rotary door actuator to generate a force tending to prevent the door from closing if the anti-pinch sensor detects the user's hand; and 2) actuate the electrically-powered rotary door actuator to rotate the door from the fully open position towards the closed position.

2. The vehicle door system of claim 1, including:

an electrically-powered latch mechanism configured to permit the door to open when the electrically-powered latch mechanism is unlatched, wherein the electrically-powered latch mechanism is configured to retain the door in a closed position when the electrically-powered latch mechanism is latched; and the controller is configured to actuate the electrically-powered latch mechanism prior to actuating the electrically-powered rotary door actuator to open the door.

3. The vehicle door system of claim 2, wherein:

the controller is configured to deactivate the electrically-powered rotary door actuator if the door encounters an object that impedes opening of the door.

4. The vehicle door system of claim 3, wherein:

the controller stops supplying electrical current to the electrically-powered rotary door actuator if an electric current to the electrically-powered rotary door actuator exceeds a predefined maximum.

5. The vehicle door system of claim 4, wherein:

the controller is configured to actuate the electrically-powered door actuator to shift the door towards the closed position if a close door request is received.

6. The vehicle door system of claim 5, including:

a door position sensor; and wherein:

the controller is configured to utilize position data from the door position sensor to determine if the door has encountered an object while closing and to deactivate the electrically-powered rotary door actuator if an object is detected.

7. The vehicle door system of claim 1, wherein:

the anti-pinch sensor is positioned on the door adjacent the rear edge portion thereof.

8. The vehicle door system of claim 1, wherein:

the vehicle structure includes adjacent front and rear door openings;

the door comprises a front door that closes off the front door opening when the front door is closed;

the anti-pinch sensor comprises a front anti-pinch sensor;

the electrically-powered rotary door actuator comprises a front electrically-powered rotary door actuator; and including:

a rear door rotatably mounted to the vehicle structure to close off the rear door when the rear door is closed;

a rear anti-pinch sensor;

a rear electrically-powered rotary door actuator that can be actuated to rotate the rear door to an open position; and wherein:

the controller is configured to cause the rear electrically-powered rotary door actuator to generate a force tending to prevent closing of the rear door if the front anti-pinch sensor detects the user's hand.

9. A vehicle comprising:

a body having an opening;

a movable door that selectively closes the opening;

an electrically-powered rotary actuator that is configured to rotate the door in open and closed directions when the electrically-powered rotary actuator is actuated;

an anti-pinch sensor configured to detect a user's hand adjacent the door opening; and a controller that causes the electrically-powered rotary actuator to generate a force that tends to prevent closing of the door when the anti-pinch sensor detects the user's hand.

10. The vehicle of claim 9, wherein:

the controller actuates the electrically-powered rotary actuator and causes the electrically-powered rotary actuator to close the door upon receiving a close door command.

11. The vehicle of claim 10, wherein:

the door includes a close door sensor that can be actuated by a user to generate a close door command to the controller.

12. The vehicle of claim 11, wherein:

the close door sensor comprises a switch on an exterior surface of the door that is configured to be manually actuated by the user.

13. The vehicle of claim 9, wherein:

the door includes an electrically-powered latch that retains the door in a closed position when the electrically-powered latch is in a latched configuration, and wherein the electrically-powered latch permits opening of the door when the electrically-powered latch is in an unlatched configuration;

and wherein the controller, upon receiving an open door command, unlatches the electrically-powered latch and then actuates the electrically-powered actuator to open the door.

14. The vehicle of claim 13, wherein:

the electrically-powered latch defines locked or unlocked states, and wherein the electrically-powered latch does not unlatch unless the electrically-powered latch is in the unlocked state.

15. The vehicle of claim 14, wherein:

the door includes an open door sensor on an exterior surface thereof that can be actuated by a user to generate an open door command.

16. The vehicle of claim 9, including:

an electrically-powered linear actuator having a plunger that shifts from a retracted position to an extended position to push the door to a partially open first check position, and wherein the electrically-powered rotary actuator rotates the door from the first check position to a fully open position, and wherein the electrically-powered rotary actuator moves the door from the fully open position to a closed position.

17. The vehicle of claim 16, Wherein:

the controller is configured to actuate the electrically-powered linear actuator to maintain the plunger in the extended position if the anti-pinch sensor detects the user's hand.

* * * * *